US006367512B2

(12) United States Patent
Feer

(10) Patent No.: US 6,367,512 B2
(45) Date of Patent: Apr. 9, 2002

(54) SHEDDING DEVICE FOR WEAVING MACHINES

(75) Inventor: Mark Feer, Winterthur (CH)

(73) Assignee: AGM Jactex AG, Neuhausen am Rheinfall (CH)

( * ) Notice: Subject to any disclaimer, the term of this patent is extended or adjusted under 35 U.S.C. 154(b) by 0 days.

(21) Appl. No.: 09/773,301

(22) Filed: Jan. 31, 2001

(30) Foreign Application Priority Data

Mar. 1, 2000 (CH) ..... 0399/00

(51) Int. Cl.[7] ..... D03C 3/44

(52) U.S. Cl. ..... 139/93; 139/1 C; 139/82; 139/85

(58) Field of Search ..... 139/93, 85, 1 C, 139/82

(56) References Cited

U.S. PATENT DOCUMENTS 4,513,789 A * 4/1985 Bowen, Jr. et al. ..... 139/85

5,094,274 A * 3/1992 Bucher et al. ..... 139/82

FOREIGN PATENT DOCUMENTS

| | | |
|---|---|---|
| DE | 26 51 057 | 5/1978 |
| EP | 0 094 270 | 11/1983 |
| EP | 0 292 632 | 11/1988 |

OTHER PUBLICATIONS

Patent Abstracts, JP 03 097 935, Apr. 23, 1991.

* cited by examiner

*Primary Examiner*—Andy Falik
(74) *Attorney, Agent, or Firm*—Herbert Dubno

(57) ABSTRACT

A shedding device for a weaving machine whose heddles are connected to respective return springs and wherein the springs have casings surrounding them. A lip seal on an end of each casing surrounding a rod portion of the heddle forms a hermetic seal against the rod portion to prevent dust and fluff from collecting on the respective spring.

3 Claims, 1 Drawing Sheet

SHEDDING DEVICE FOR WEAVING MACHINES

CROSS REFERENCE TO RELATED APPLICATION

This application claims the priority of Swiss Application No. 2000 0399/00 filed Mar. 01, 2000, which is incorporated herein by reference.

FIELD OF THE INVENTION

This invention relates to a shedding device for weaving machines whose warp threads guided in heddles between an upper shed position and a lower shed position are moved back and forth, whereby tension springs to return the heddles to the lower shed position move axially in a surrounding casing and grip each heddle, and the tension springs are attached to a downward-pulling base or rod of a downward-pulling frame.

BACKGROUND OF THE INVENTION

Relevant shedding devices include so-called Jacquard machines in which the bottom end of two hooks are connected via a common pulley, whereby the hooks can be coupled to two stroke measuring devices that continuously move in the opposite direction depending upon the means of control, e.g. by magnetic means, whereby the heddles, e.g. suspended on the pulley, and hence the relevant warp threads are provided with a controlled stroke movement between the top shed position and bottom shed position. To return the heddles into the bottom shed position, a tension spring grips each heddle that is attached to a downward pulling base or downward-pulling rods of a downwardpulling frame.

A familiar problem with such machines is the accumulation of dust and fluff on the return springs which can quickly cause problems and requires long machine downtimes to eliminate the problem. It has been attempted to solve the problem by surrounding the tension springs gripping the heddles with a sleeve in which the relevant return springs move in an axial direction; however, this cannot prevent dust and fluff from penetrating the sleeves from the open face and clogging the return spring. The caps that are used in this context are also ineffective.

SUMMARY OF THE INVENTION

The object of the present invention is therefore to create a system that effectively prevents the collection of dust and fluff on the return springs to essentially eliminate downtime arising from such problems.

This object is attained according to the invention by placing a device to prevent dust and fluff from collecting on the return spring at the face of the sleeve that moves axially relative to the affected heddle.

Preferably, the device to prevent dust and fluff from collecting on the return spring can be a hermetically sealing lip seal surrounding the relevant heddle and/or hook or connecting means that sits tightly on the face or end of the sleeve.

It is advantageous for the lip seal to be exchangeable in a cage or the face of the sleeve or directly insertable in the cage. The lip seal acts as a dust or fluff remover on the heddle and/or hook or connecting means.

It is preferable for the lip seal to be a micro-lip ring seal.

These measures provide an optimum means for keeping the return springs clean with a relatively simple construction, and also prevent existing shedding devices of the cited kind to be retrofitted as desired independent of the fixed connection between the heddle or hook or connecting means and sleeve on the warp side or downward-pulling base side. The lip seal lies at the face where the sleeve moves axially relative to the affected heddle.

BRIEF DESCRIPTION OF THE DRAWINGS

An embodiment of the subject matter of the invention is explained below in greater detail with reference to the accompanying drawing, wherein.

DETAILED DESCRIPTION OF THE INVENTION

Figure 1:
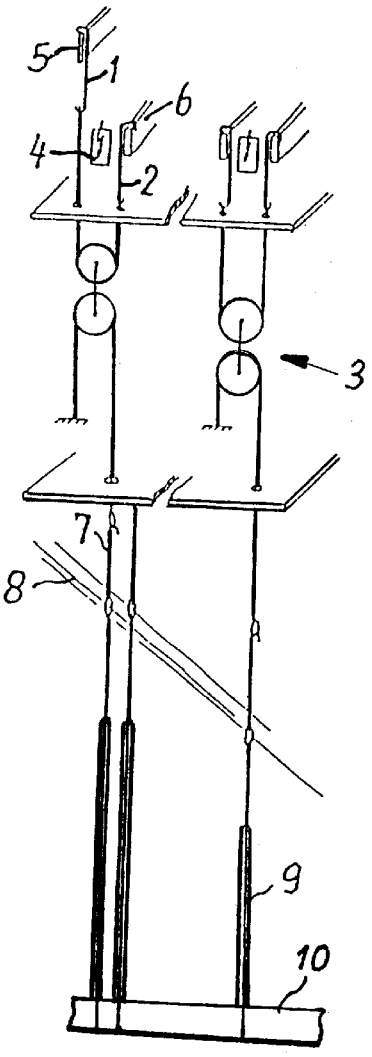
Fig.1 PRIOR ART
FIG. 1 shows a schematically illustrated section of a shedding device for weaving machinery.

The shedding device for weaving machinery according to FIG. 1 is an open-shed Jacquard machine in which the bottom ends of two hooks 1 and 2 are connected via a common pulley 3 whereby the hooks can be coupled to two stroke measuring devices 5, 6 that continuously move in the opposite direction depending upon the means of control (here magnetic means 4), whereby the heddle 7 suspended from the pulley and hence the relevant warp threads 8 are provided with a controlled stroke movement between the top shed position (left side, FIG. 1) and bottom shed position (right side).

Such shedding devices for weaving machines are prior art, although there are numerous other systems for moving the heddles with the warp threads to form sheds.

A common element of a number of such prior-art shedding devices is that a tension spring 9 is attached to the heddle directly or via a hook or other connecting means to return the heddle 7 into the lower shed position. The tension spring is fixed to a downwardpulling base 10 or to downward-pulling rods of a downward-pulling frame (not shown).

Figure 2:
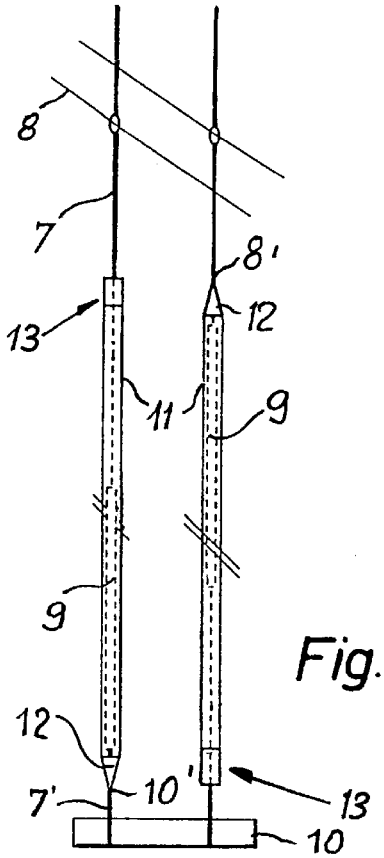
FIG. 2 shows an enlarged heddle arrangement with a fixed connection at the downward-pulling base side and warp side between the hook or heddle and sleeve from the arrangement in FIG. 1.

In addition, there exists a prior-art embodiment in which each tension spring 9 attached to a heddle 7 is surrounded by a sleeve in 11 in which the relevant tension spring moves in an axial direction (FIG. 2).

According to the invention, there is a device 13 on the end of the sleeve 11 to prevent dust and fluff from collecting on the tension spring 9 (FIG. 3) that moves in an axial direction relative to the affected heddle 7.

Figure 3:
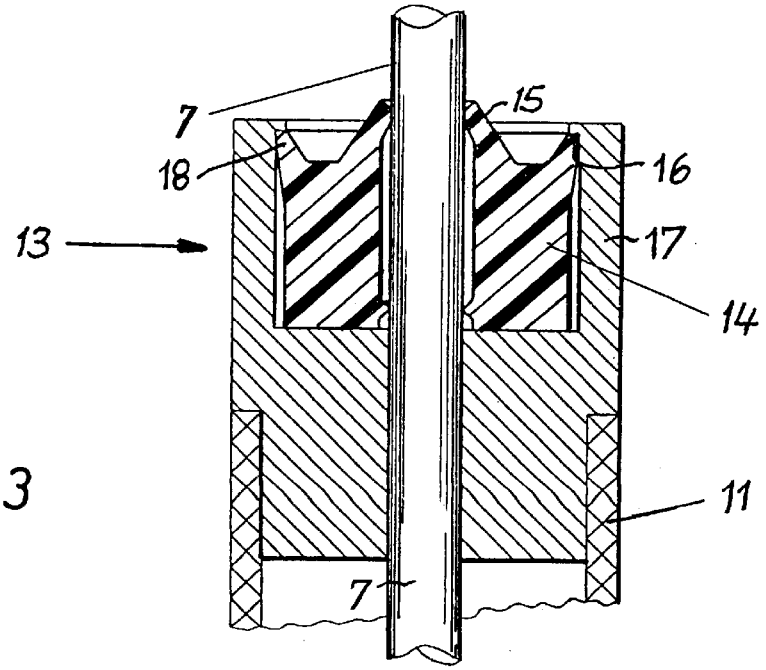
FIG. 3 an enlarged section of the device according to the invention to prevent dust and fluff collection on the return spring in the form of a slip seal surrounding the relevant heddle and contacting it that is tightly fixed to the relevant face of the sleeve.

As shown in greater detail in FIG. 3, the device 13 to prevent dust and fluff formation on the return spring is a seal 14 (micro-lip ring seal) surrounding and hermetically sealing the relevant heddle 7 or hook or connecting means that is tightly fixed to the relevant face of the sleeve. The lip seal and the heddle and/or hook or connecting means acts as a dust and fluff remover.

The lip seal 14 is preferably exchangeable in a cage 17 at the end of the sleeve 11. The face of the cage has a ring shoulder 16 that looks like an expandingring-like projection 18 and is on the outer edge of the body of the lip seal, an inner lip 15 of which engages the heddle 7.

Such a return device on a shedding device is practically problemfree and wear-free since the measures according to invention provide an optimum method for keeping the return springs clean.

Of course variations of the design are possible within the framework of the inventive idea. For example, a device according to invention to prevent the collection of dust and fluff on the return spring can also be provided at both faces on ends of the relevant sleeve. In addition, the lips seal can preferably be a micro-lip ring seal that preferably consists of polyurethane, etc. which can be directly on the face of the sleeve without a cage.

What is claimed is:

1. A shedding device for a weaving machine, comprising:

heddles shiftable between an upper shed position and a lower shed position for guiding respective warp threads;

respective tension springs acting on said heddle and respectively connected to said heddles for returning said heddles to the respective lower shed position;

a casing surrounding each of said springs and having an end movable axially relative to a rod portion of the respective heddle; and a device to prevent dust and fluff from collecting on the respective spring and comprised of a lip seal on the respective end of each casing, surrounding the respective rod portion and having a sealing lip slidably bearing on and hermetically sealing around the respective rod portion.

2. The shedding device defined in claim 1 wherein each of said ends of said casings is formed with a respective cage and the respective lip seal is replaceably fitted in the respective cage.

3. The shedding device defined in claim 1 wherein each seal is a micro-lip ring seal.

* * * * *